US009932790B2

(12) United States Patent
Kulage

(10) Patent No.: US 9,932,790 B2
(45) Date of Patent: Apr. 3, 2018

(54) CASING CUTTING TOOL, WITH STABILIZING STRUCTURE

(71) Applicant: Deltide Energy Services, LLC, Harvey, LA (US)

(72) Inventor: Timothy J. Kulage, Baton Rouge, LA (US)

(73) Assignee: ABRADO, INC., Houston, TX (US)

( * ) Notice: Subject to any disclaimer, the term of this patent is extended or adjusted under 35 U.S.C. 154(b) by 428 days.

(21) Appl. No.: 14/383,611

(22) PCT Filed: Mar. 8, 2013

(86) PCT No.: PCT/US2013/029846
§ 371 (c)(1),
(2) Date: Sep. 8, 2014

(87) PCT Pub. No.: WO2013/134629
PCT Pub. Date: Sep. 12, 2013

(65) Prior Publication Data

US 2015/0096753 A1 Apr. 9, 2015

Related U.S. Application Data

(60) Provisional application No. 61/608,942, filed on Mar. 9, 2012.

(51) Int. Cl.

| | |
|---|---|
| ***E21B 29/06*** | (2006.01) |
| ***E21B 29/00*** | (2006.01) |
| ***E21B 10/32*** | (2006.01) |
| ***E21B 17/10*** | (2006.01) |

(52) U.S. Cl.
CPC ..... *E21B 29/005* (2013.01); *E21B 10/322* (2013.01); *E21B 17/1021* (2013.01)

(58) Field of Classification Search
CPC .... E21B 10/322; E21B 10/327; E21B 29/005; E21B 10/32
USPC ..... 166/297, 298, 55, 55.1, 55.2, 55.3, 55.6, 166/55.7, 55.8; 30/103, 104, 108
See application file for complete search history.

(56) References Cited

U.S. PATENT DOCUMENTS 2,899,000 A * 8/1959 Medders ..... E21B 29/002 166/55.8
4,081,042 A * 3/1978 Johnson ..... E21B 17/1014 175/267

(Continued)

*Primary Examiner* — Kenneth L Thompson
(74) *Attorney, Agent, or Firm* — Law Office of Jesse D. Lambert, LLC

(57) ABSTRACT

A casing cutting tool, to be disposed downhole in a casing string on a drillstring, for the cutting and/or milling of casing strings. The tool has a main body with a plurality of rotatable blades which can rotate between a first retracted position to a second position substantially at right angles to the main body. In this second position, cutting surfaces on the blades engage the casing wall, and rotation of the tool results in cutting of the casing. A plurality of stabilizing arms are rotatably attached to the main body. A link between the blades and the stabilizing arms forces the stabilizing arms to rotate outward when the blades rotate outward. The stabilizing arms are dimensioned to span the inner diameter of the casing string, while leaving clearance to rotate the tool. The outermost ends of the stabilizing arms are rounded to avoid cutting the casing and reduce drag.

9 Claims, 3 Drawing Sheets

(56) References Cited

U.S. PATENT DOCUMENTS

| | | | | | |
|---|---|---|---|---|---|
| 4,809,793 | A * | 3/1989 | Hailey | E21B 10/322 | 166/297 |
| 5,265,675 | A * | 11/1993 | Hearn | E21B 10/322 | 166/297 |
| 5,732,770 | A * | 3/1998 | Beeman | E21B 29/005 | 166/55.8 |
| 5,853,054 | A * | 12/1998 | McGarian | E21B 10/322 | 175/267 |
| 6,920,923 | B1 * | 7/2005 | Pietrobelli | E21B 29/005 | 166/55.2 |
| 9,187,971 | B2 * | 11/2015 | Hutchinson | E21B 29/005 | |

* cited by examiner

CASING CUTTING TOOL, WITH STABILIZING STRUCTURE

CROSS REFERENCE TO RELATED APPLICATIONS

This regular patent application claims priority to U.S. Provisional Patent Application Ser. No. 61/608,942, filed Mar. 9, 2012, for all purposes.

BACKGROUND

Various tools have been developed for downhole cutting or severing of casing strings in wellbores, and for cutting or milling window sections in casing strings. Generally, such tools have comprised a main body with multiple hinged arms or blades, which are rotated outwardly into contact with the casing (by hydraulic or other means) when the tool is in position downhole. Usually, fluid is pumped down through the drillstring and through the tool to actuate the mechanism and rotate the blades outward. Once the blades are rotated outwardly, rotation of the drillstring (and tool) causes the cutting surfaces on the blades to cut through the casing string. Fluids are pumped through the system to lift the cuttings to the surface. Issues arise, however, in the cutting or milling of windows in multiple, cemented-together casing strings. Frequently, the multiple casing strings are not concentrically positioned with respect to one another, which gives rise to an offset position of the cutting tool with respect to the outer casing strings. This is further aggravated by the cutting tool not being concentrically positioned within the innermost casing string, but instead rotating off-center. Fixed or rigid stabilizer devices are of limited value for centralization of the cutting tool.

SUMMARY OF THE INVENTION

The present invention comprises a casing cutting tool, to be disposed downhole in a casing string by a tubular string (drillstring), for the cutting and/or milling of casing strings. The tool has a main body with a plurality of rotatable blades which can rotate between a first position, generally retracted within the main body, to a second position substantially at right angles to the main body. When in this second position, cutting surfaces on the blades engage the casing wall, and rotation of the tool results in cutting of the casing. The blades are rotated by an internal mechanism, comprising a piston in a bore of the main body which is pushed downward by fluid pumped through the tool. The piston bears on heel portions of the blades, forcing them to rotate outward. A plurality of stabilizing arms are also rotatably attached to the main body, usually in a downhole position from the cutting blades. A link member between the blades and the stabilizing arms forces the stabilizing arms to rotate outward when the blades rotate outward. The stabilizing arms are dimensioned so as to substantially span the inner diameter of the casing string, while leaving sufficient clearance to rotate the tool. Preferably, the outermost ends of the stabilizing arms are rounded to avoid cutting the casing and to reduce drag.

DESCRIPTION OF THE PRESENTLY PREFERRED EMBODIMENT(S)

Figure 1:
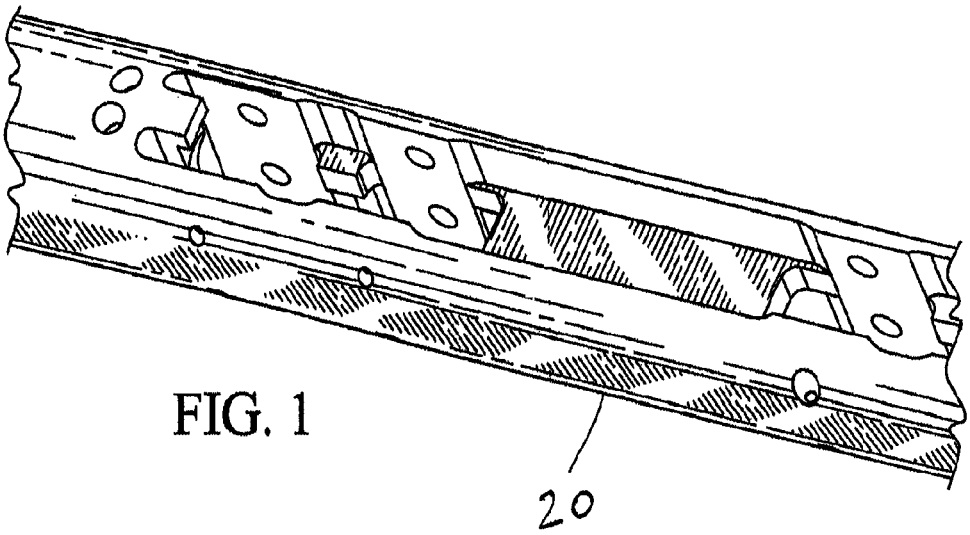
FIG. 1 is a perspective side view in partial cutaway of the main body of an exemplary tool embodying the principles of the present invention.

While a number of embodiments are possible, within the scope of the invention, with reference to the drawings some of the presently preferred embodiments can be described.

Note that the annotations in the drawings of "uphole" point generally to the surface of the earth, as that term is well known in the relevant industry, and are simply to show a typical orientation of the tool in a wellbore.

Figure 2:
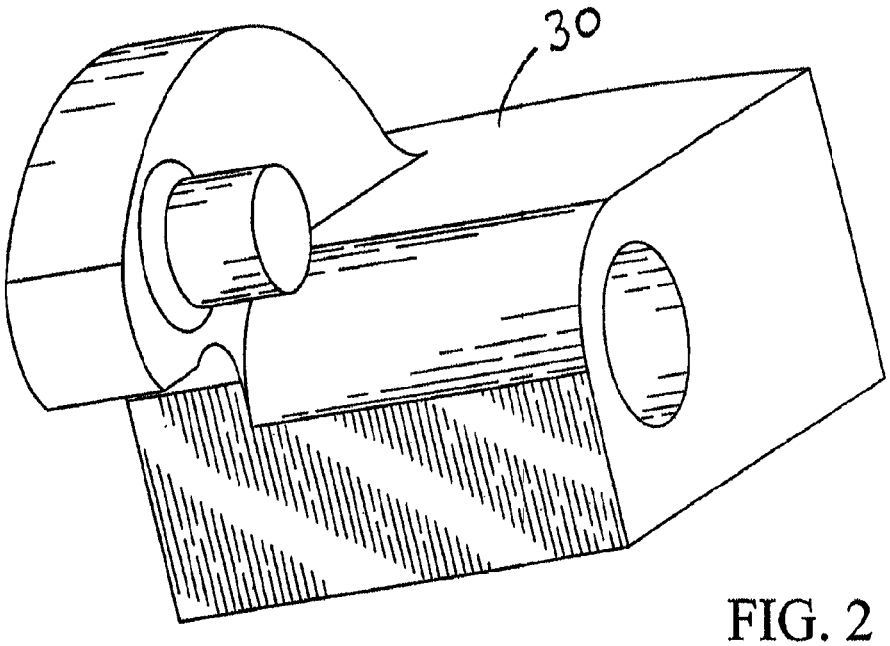
FIG. 2 is a perspective view of one embodiment of a stabilizing arm.

FIG. 1 shows main body 20 of stabilized downhole cutting tool 10, showing some detail of the interior cavity within which the operating mechanism, blades and cutters, and stabilizing arms are positioned, as will be further described. FIG. 2 shows a stabilizing arm 30.

Figure 3:
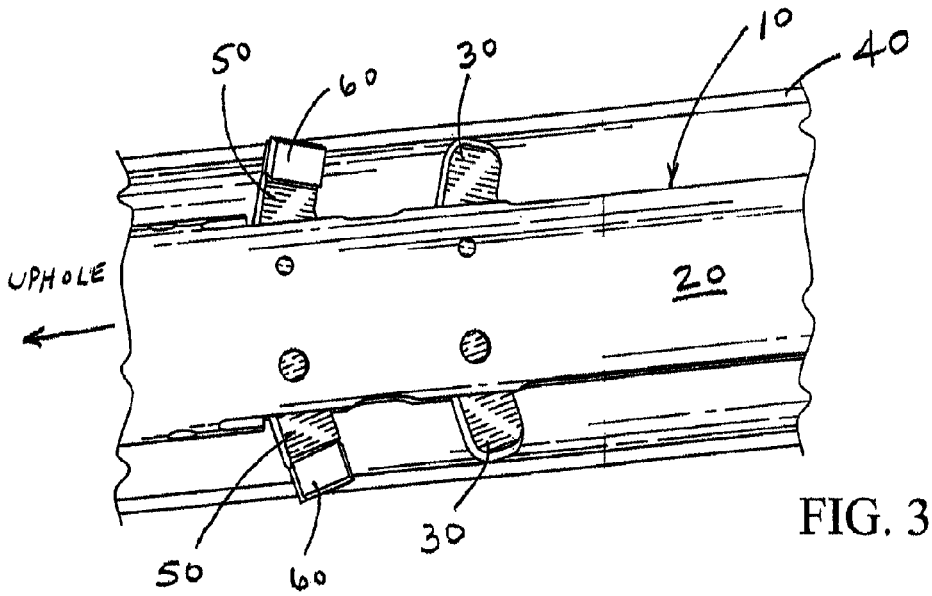
FIG. 3 is a side view of a downhole cutting tool embodying the principles of the present invention, in downhole position within a casing string, with the stabilizing arms extended and the cutters in contact with and partially cut through the casing wall.

FIG. 3 shows stabilized downhole cutting tool 10, in position within a casing string 40. Stabilizing arms 30 are extended radially outward so as to contact the inner wall of casing string 40, thereby centering tool 10 within the casing string. Blades 50 have hardened cutting surfaces thereon; in the illustrated embodiment, blades 50 have hardened cutting surfaces in the form of cutters 60 mounted on their outermost ends, are partially extended outward; in the position in FIG. 3, cutters 60 have partially cut through the wall of casing 40. It is understood that the cutting surfaces can take various forms, for example carbide surfaces, carbide shaped "buttons," polycrystalline diamond compact or PDC inserts, etc. The cutting surface can simply be a hardened coating on the surface of blades 50, or, as in the illustrated embodiment, can comprise multiple spaced-apart cutters 60 mounted on the ends of blades 50.

Figure 4:
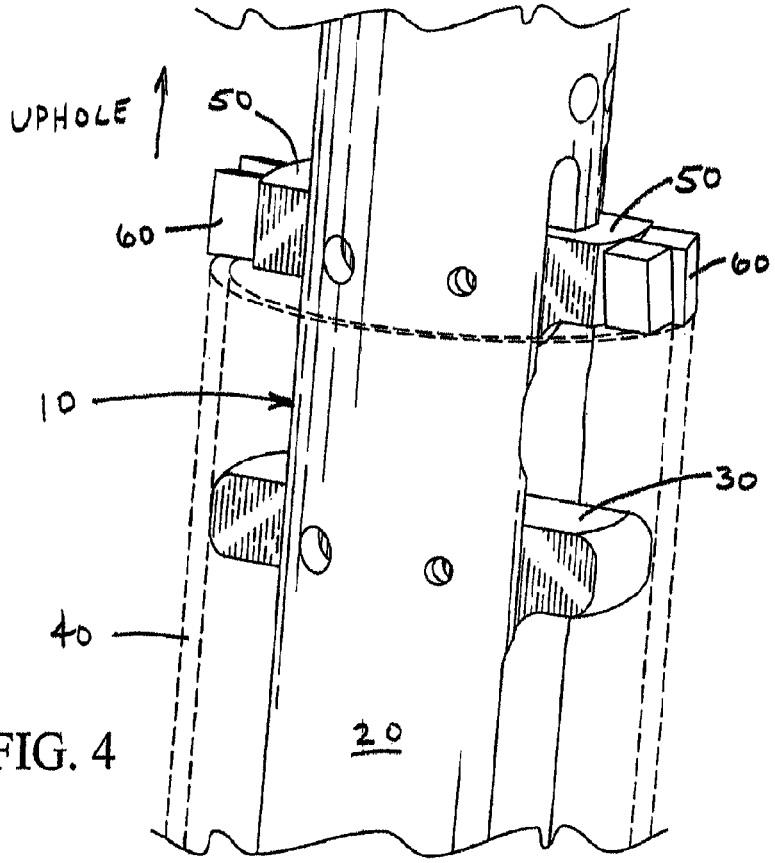
FIG. 4 is another side view of the downhole cutting tool of FIG. 3, in position in a casing string (phantom lines), showing the cutters fully extended and cutting on the upwardly-facing casing edge, and the stabilizing arms fully extended.

FIG. 4 shows blades 50 fully extended (generally, to a right angle with the axis of tool 10), with cutters 60 now cutting or milling on the upwardly facing surface or edge of casing 40. Stabilizing arms 30 are also fully extended (generally, to a right angle with the longitudinal axis of tool 10), thereby centering cutting tool 10 within the casing, as earlier described.

Figure 5:
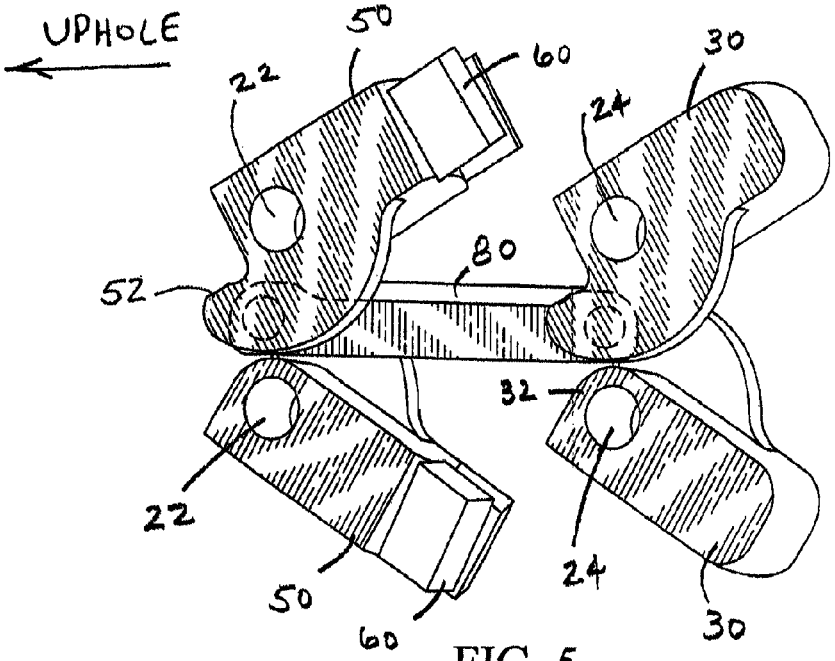
FIG. 5 is a detail view of the cutters and stabilizing arms, and the mechanical linkage joining the two.

Casing cutting tool 10 comprises a means for rotating blades 50 and stabilizing arms 30 from their first, retracted positions, to their second, extended positions, substantially at right angles to the axis of main body 20. In the preferred embodiment, the means for rotating comprises the mechanism as shown in FIG. 5, illustrating an exemplary operating mechanism for both blades 50 and stabilizing arms 30. As is known in the art, cutting tool 10 is positioned downhole in a casing string of a wellbore by running same down on a drillstring. Drilling fluids (which may be "mud" or clear fluids) are pumped down the bore of the drillstring, and through the bore 26 of main body 20 of cutting tool 10. As will be described in more detail with regard to FIG. 6, during operation of the cutting tool, as the fluids are pumped, piston 70 is pushed in a downhole direction by the passage of the drilling fluid through bore 72 of piston 70. Piston 70 bears on heel portions 52 of blades 50. Blades 50 are rotatably fixed within main body 20 of cutting tool 10, by pins or similar members inserted through holes 22; as such, it can be understood that movement of piston 70 on heel portions 52 results in rotation of blades 50 radially outward. This same rotation forces link 80, which is connected to heel portions 52, in a downhole direction. Link 80 is connected to a heel portion 32 of stabilizing arms 30. Similar to blades 50, stabilizing arms 30 are rotatably fixed within main body 20 of cutting tool 10, by pins or similar members inserted through holes 24, and movement of link 80 in a downhole direction results in rotation of stabilizing arms 30 radially outward.

Figure 6:
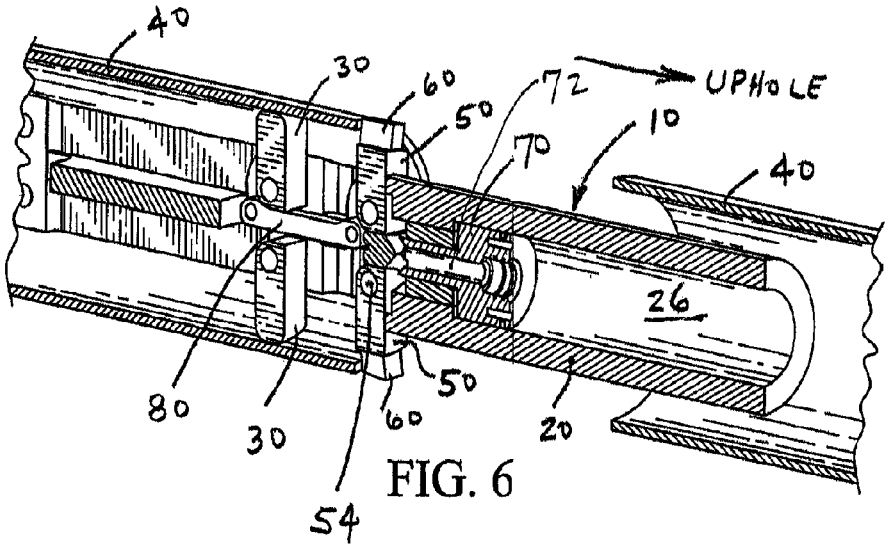
FIG. 6 is a section view of a cutting tool embodying the principles of the present invention, in the same position as shown in FIG. 4, showing detail regarding the mechanism which moves the cutters and stabilizing arms into position.

FIG. 6 is a cutaway view of a stabilized cutting tool 10 embodying the principles of the current invention, in place within a casing string 40 and having cut or milled away a section of casing as noted in the drawing. Cutting tool 10 is positioned downhole on a drillstring, through which fluids (which may be drilling mud, completion fluids, or other fluids) is pumped, which ultimately pass through a central bore 26 in cutting tool 10. A piston 70 is slidably disposed within a chamber in main body 20. Piston 70 has a longitudinal bore 72, through which the fluids pass. Since bore 72 presents a reduced flow area, piston 70 is forced in a downhole direction by passage of the drilling fluid.

As previously described in relation to FIG. 5, piston 70 bears upon heel portion 52 of blades 50, forcing them in a downhole direction, rotating around pins 54, which rotates blades 50 and cutters 60 outward. In FIG. 6, blades 50, and consequently cutters 60, are in a fully outwardly rotated position. Link 80 is operatively coupled to stabilizing arms 30, and has forced heel portions 32 of stabilizing arms 30 in a downhole direction, rotating stabilizing arms 30 outward to their full extent, as shown in the drawing. The outward profile of stabilizing arms 30 are preferably rounded to prevent cutting into casing 40, and to reduce the friction between stabilizing arms 30 and the inner wall of casing 40. Stabilizing arms 30 are dimensioned so as to substantially span the inner diameter of casing string 40, while leaving sufficient clearance to rotate cutting tool 10 therein. Different dimension parameters can be selected as desired. As can be readily appreciated from the figures, stabilizing arms 30 serve to centralize cutting tool 10 within casing 40, thereby keeping cutters 60 properly positioned with respect to casing 40, preferably in the position shown in FIG. 4.

It is to be understood that different mechanisms can be used to rotate blades 50 and stabilizing arms 30 from a first, retracted position, generally within main body 20 and not protruding significantly therefrom; to a second, extended position, wherein blades 50 and stabilizing arms 30 are partially, or fully (as seen in FIG. 6) extended from the main body. While not confining the current invention to any particular operating mechanism, one suitable mechanism is that disclosed in U.S. Pat. No. 7,063,155, owned by the assignee of this invention. Cutting tool 10 may comprise two, three, or more blades, although two blades may be the preferred number and are shown in the drawings.

Method of Use of the Cutting Tool

An exemplary method of use of the stabilized cutting tool can now be described. A set of blades 50 (which may comprise multiple cutting surfaces or cutters attached to each blade 50) is selected with dimensions appropriate for the size casing that is to be cut. A set of stabilizing arms 30 with dimensions appropriate for the size casing in which the tool will be operated is also selected, and both the blades and stabilizing arms are installed in the tool. Stabilizing arms 30 are preferably dimensioned so as to substantially span the inner diameter of the casing string within which the tool is run, while allowing sufficient clearance to rotate cutting tool 10. Cutting tool 10 is lowered to the desired depth, on a tubular string, commonly referred to as the drillstring or work string. Fluids are then pumped down the drillstring through the bore of main body 20 of cutting tool 10, which as described forces piston 70 in a downhole direction. Piston 70 bears on heel portions 52 of blades 50, and rotates blades 50 (and attached cutters) outwardly from main body 20, under influence of the operating mechanism, as previously described, and into the position of FIG. 6. The cutters contact the inner wall of the casing; more particularly, the uppermost corners of the cutters come into contact with the casing wall, generally as shown in FIG. 3. Simultaneously, link 80 is forced in a downhole direction, and through the connection with stabilizing arms 30 rotates said stabilizing arms 30 to the position in FIG. 3. Rotation of the tool can be started, and as cutters 60 (being pressed against the casing wall by the opening mechanism of the tool) cut through casing 40, both blades 50 and stabilizing arms 30 gradually move to their fully extended position as shown in FIGS. 4 and 6. This would complete a cut through the casing wall.

In order to mill a section of casing out, in order to create a window, once the initial cut was made and blades 50 and stabilizing arms 30 were in their fully extended position, a desired weight is set down on cutting tool 10, by slacking off on the drillstring. This in turn forces blades 50 and cutting surfaces, such as cutters 60, against the uphole-facing edge of casing string 40, as seen in FIG. 4. Continued rotation of cutting tool 10 then permits cutters 60 to mill the casing, which can be continued as needed to achieve the desired window length.

Once the desired length of window has been cut, fluid flow is stopped, the blades/cutters and stabilizing arms retract into the tool body, and cutting tool 10 can be retrieved from the well with the drillstring.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example, dimensions of the various components of the tool can be varied to suit particular jobs; the number of blades can be varied, to three or more; different types of cutting surfaces can be used; the stabilizing mechanism can be used in conjunction with tools other than or in addition to cutters, etc.

Therefore, the scope of the invention is to be determined not by the illustrative examples set forth above, but by the appended claims and their legal equivalents.

I claim:

1. A downhole casing cutting tool for positioning downhole in a casing string, comprising:

an elongated main body having a bore therethrough;

a plurality of blades rotatably attached to said main body, movable between a first position retracted in said main body and a second position rotated outwardly substantially at right angles to said main body, said blades comprising heel portions within said bore of said body providing bearing surfaces for causing rotation of said blades, said blades dimensioned so as to extend radially at least as far as an outer diameter of said casing;

a piston slidably disposed in said bore of said main body, said piston having a longitudinal bore therethrough, whereby fluid pumped through said bore of said main body and said bore of said piston forces said piston downward, a lowermost end of said piston bearing against said heel portions of said blades and rotating them to said second position;

a plurality of stabilizing arms rotatably attached to said main body below said blades, movable between a first position retracted in said main body and a second position rotated outwardly substantially at right angles to said main body, said stabilizing arms dimensioned so as to substantially span an inner diameter of said casing string but not extend beyond said inner diameter of said casing string, said stabilizing arms comprising no cutting surfaces thereon; and a link pinned to and joining said blades and said stabilizing arms, whereby rotation of said blades moves said link, said link operatively coupled to said stabilizing arms so as to rotate them outward when said blades rotate outward.

2. The casing cutting tool of claim 1, wherein said blades comprise hardened cutting surfaces engaging said casing.

3. The casing cutting tool of claim 1, wherein said blades comprise a plurality of cutters attached to outer ends of said blades.

4. The casing cutting tool of claim 3, wherein said stabilizing arms comprise rounded outer ends.

5. A downhole casing cutting tool for positioning downhole in a casing string, comprising:

an elongated main body having a bore therethrough, and a means for attachment to a drill string;

a plurality of blades rotatably attached to said main body, movable between a first position retracted in said main body and a second position rotated outwardly substantially at right angles to said main body, said blades dimensioned so as to extend radially at least as far as an outer diameter of said casing;

a plurality of stabilizing arms rotatably attached to said main body, movable between a first position retracted in said main body and a second position rotated outwardly substantially at right angles to said main body, said stabilizing arms dimensioned so as to substantially span an inner diameter of said casing string but not extend beyond said inner diameter of said casing string, said stabilizing arms comprising no cutting surfaces thereon; and a means for rotating said blades and said stabilizing arms to said second positions, wherein said blades comprise heel portions within said bore of said main body providing bearing surfaces for causing rotation of said blades, and said means for rotating said blades and said stabilizing arms comprises a piston slidably disposed in said bore of said main body, said piston having a longitudinal bore therethrough, whereby fluid pumped through said bore of said main body and said bore of said piston forces said piston downward, a lowermost end of said piston bearing against said heel portions of said blades and rotating them to said second position; and a link pinned to and joining said blades and said stabilizing arms, whereby rotation of said blades moves said link, said link operatively coupled to said stabilizing arms so as to rotate them outward when said blades rotate outward.

6. The cutting tool of claim 5, wherein said stabilizing arms are positioned in said main body in a downhole direction from said blades.

7. The casing cutting tool of claim 5, whereby said blades comprise a plurality of cutters attached to outer ends of said blades.

8. The casing cutting tool of claim 7, wherein said stabilizing arms comprise rounded outer ends.

9. A method for severing casing strings at a downhole point in a wellbore, comprising the steps of:

a) providing a casing cutting tool, comprising:

an elongated main body having a bore therethrough, and a means for attachment to a drillstring;

a plurality of blades rotatably attached to said main body, movable between a first position retracted in said main body and a second position rotated outwardly substantially at right angles to said main body, said blades dimensioned so as to extend radially at least as far as an outer diameter of said casing;

a plurality of stabilizing arms rotatably attached to said main body, movable between a first position retracted in said main body and a second position rotated outwardly substantially at right angles to said main body, said stabilizer arms dimensioned so as to substantially span an inner diameter of said casing string but not extend beyond said inner diameter of said casing string, said stabilizing arms comprising no cutting surfaces thereon; and a means for rotating said blades and said stabilizing arms to said second positions;

b) lowering said cutting tool on a drillstring to a desired downhole location within a casing string in a wellbore;

c) pumping fluid through said drillstring and said bore of said cutting tool, thereby rotating said blades and said stabilizing arms to their second, outwardly rotated positions, wherein said blades engage and cut into and through said casing string and said stabilizing arms bear against an inner surface of said casing string and centralize said cutting tool within said casing string;

d) rotating said cutting tool via rotation of said drillstring;

e) rotating said cutting tool until said blades have cut completely through said casing string and are fully rotated to their second position;

f) lowering said cutting tool until said blades are contacting an upward-facing edge of said cut casing; and g) placing a desired weight on said cutting tool, and continuing to rotate said cutting tool so as to mill a window of desired length in said casing.

* * * * *